US006006450A

United States Patent [19]

Hayes

[11] Patent Number: 6,006,450

[45] Date of Patent: Dec. 28, 1999

[54] WEAR RESISTANT GRIND SHOE APPARATUS

[75] Inventor: William J. Hayes, Portland, Oreg.

[73] Assignee: Artemis Innovations Inc., Torrance, Calif.

[21] Appl. No.: 09/132,838

[22] Filed: Aug. 12, 1998

[51] Int. Cl.[6] ..... A43B 23/00; A43B 5/04

[52] U.S. Cl. ..... 36/107; 36/115; 36/25 R

[58] Field of Search ..... 36/115, 107, 108, 36/113, 72 A, 73, 25 R, 152, 167, 132, 91

[56] References Cited

U.S. PATENT DOCUMENTS

| | | | |
|---|---|---|---|
| 34,689 | 3/1862 | Meyer | 36/72 A |
| 234,030 | 11/1880 | Hadley et al. . | |
| 875,560 | 12/1907 | Vaughn . | |
| 892,152 | 6/1908 | Harman . | |
| 1,189,329 | 7/1916 | Winagle . | |
| 1,428,232 | 9/1922 | Holmen . | |
| 1,984,989 | 12/1934 | Reed . | |
| 2,484,935 | 10/1949 | De Rooy . | |
| 2,490,469 | 12/1949 | Pittman . | |
| 3,486,250 | 12/1969 | Purtle . | |
| 4,316,334 | 2/1982 | Hunt . | |
| 4,691,453 | 9/1987 | Tifre . | |
| 5,249,376 | 10/1993 | Capria . | |
| 5,319,866 | 6/1994 | Foley et al. . | |
| 5,388,350 | 2/1995 | Parker, Jr. . | |
| 5,398,970 | 3/1995 | Tucky | 36/115 |
| 5,425,186 | 6/1995 | Hoyt | 36/97 |
| 5,632,104 | 5/1997 | Zohar | 36/25 R |
| 5,638,614 | 6/1997 | Hardy . | |
| 5,716,723 | 2/1998 | Van Cleef et al. | 36/25 R |

FOREIGN PATENT DOCUMENTS

| | | |
|---|---|---|
| PCT/US97/11652 | 7/1997 | WIPO . |

*Primary Examiner*—M. D. Patterson

*Attorney, Agent, or Firm*—Fulwider Patton Lee & Utecht, LLP

[57] ABSTRACT

Shoe apparatus including a midsole movable relative to a runner or a rigid plate surmounted by such midsole and a wear resistant tab on such midsole to accommodate the relative movement.

23 Claims, 2 Drawing Sheets

WEAR RESISTANT GRIND SHOE APPARATUS

BACKGROUND OF THE INVENTION

1. Field of the Invention

The invention relates to articles of footwear in general, and in particular to articles of footwear adapted to facilitate an athletic activity involving the sliding or rolling along an edge defining a support surface such as a rail, curb or the like.

2. Description of the Prior Art

Athletic footwear has gained immense popularity in the United States and throughout the world to be worn during exercise activities. Athletic footwear is known incorporating hard soles often used in bowling activity and to mount cleats used in baseball or softball athletic contests. Other athletes prefer shoes with cushioned soles such as in the case of tennis shoes or basketball shoes.

Other athletic or entertainment activity which has gained immense popularity in recent years is skateboarding and in-line roller skating. Highly athletic youthful participants have developed a maneuver commonly referred to as "grinding," wherein the athlete will jump into the air while riding a skateboard or wearing a pair of in-line skates and slide the undercarriage along an elongated track defined by, for instance, a hand rail, park bench back or curb edge.

Grinding shoes have been proposed which incorporate a hard plate in the arch area or other strategic location, typically on the sole of the shoe so the wearer can wear the shoe in a normal manner throughout the day and when the opportunity presents itself for a grinding activity, he or she can run toward a sliding surface formed by a rail, curb or the like, and leap upwardly mounting such sliding surface with the hard plate to slide such plate therealong. This activity has gained great popularity in the field and is currently enjoyed by many youngsters utilizing shoes marketed under the trademark SOAP® by the assignee of the present application. Such shoes incorporate grind plates of the type disclosed in U.S. patent application Ser. No. 08/890,595, filed Jun. 9, 1997, U.S. patent application Ser. No. 08/799,062, filed Feb. 10, 1997, which claims priority to U.S. provisional patent application Ser. No. 60/022,318, filed Jul. 23, 1996, all assigned to the assignee of the present application.

The SOAP® grind plates are typically constructed with a saddle configuration to provide a downwardly open semi-cylindrical trough configured at the upper extent with a shaft line bearing surface extending from the lateral to the medial side of the shoe to be stabilized in a non-rocking fashion when centered over the rail.

The saddle shaped plate is typically turned upwardly on the medial lateral sides of the shoe to form forwardly and rearwardly extending raised retaining flanges embracing the opposite sides of the midsole.

Such shoes have gained enthusiastic acceptance in the marketplace and afford the wearer such comfort that youngsters of school age and the like prefer to wear such shoes throughout the length of the day so as to benefit from the status associated with such a footwear article and to be in the ready to execute a grinding maneuver whenever the opportunity appropriately presents itself. Experience has shown that there is a substantial flex of the shoe relative to the grind plate and consequently, relative to such retaining flanges. This then often results in the surface material of the shoe sole adjacent such flanges becoming worn through over a period of time thus resulting in a limited life span for the shoe itself. This then deprives the wearer of the opportunity to wear the shoe for the full length of the original grind plate or of benefitting from life of the shoe beyond that of the original grind plate. Consequently, a need exists for a shoe and plate apparatus which is adaptable for the ready athletic maneuvers associated with grinding activities but yet will endure the relatively active routine imposed on such shoes by active youth.

It is also an important feature of grinding shoes that the plate and shoe combination provide the athlete with the ability to closely control the maneuver undertaken. This often involves acceleration or deceleration along a rail at a controlled rate of speed. Such speed is often controlled by the relative positioning of the feet and consequently the grind plates on the rail. The ability to decelerate or decrease the rate of acceleration along the rail often becomes more important with the more extreme exercises. Thus, there also exists a need for a grinding shoe apparatus which in certain positions provides higher frictional resistance to sliding along the rail to thereby allow the athlete to assume such certain positions to enhance the braking effect tending to control the speed over such rail.

SUMMARY OF THE INVENTION

The shoe apparatus of the present invention is characterized by a shoe midsole underlying a shoe upper and constructed of relatively flexible material such as polyurethane which has a characteristic of being subject to abrasion and wear from extended and repeated rubbing against the adjacent surface of a grind plate. The midsole is formed in the arch area with a downwardly opening laterally projecting arcuate cavity extending laterally of the shoe for mounting on such grid plate. The grind plate is mounted in the cavity and is preferably generally saddle shaped and formed at its opposite edges with upwardly turned retaining flanges extending longitudinally along the medial and lateral sides of the midsole in the arch area. In one aspect of the present invention a wear resistant tab is interposed between at least one, or in some instances both, of such runners and the adjacent side of the midsole to accommodate relative movement between the midsole and the adjacent runner to protect the midsole itself from excessive wear.

In another aspect of the present invention, a high friction tab is mounted to one side or the other, or in some instances both sides, of the midsole to project upwardly along the side of the midsole above the respective flange to be, in certain shoe orientations, contacted with the underlying support surface to act as a brake to frictionally resist continued movement along the rail.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENT

Figure 1:
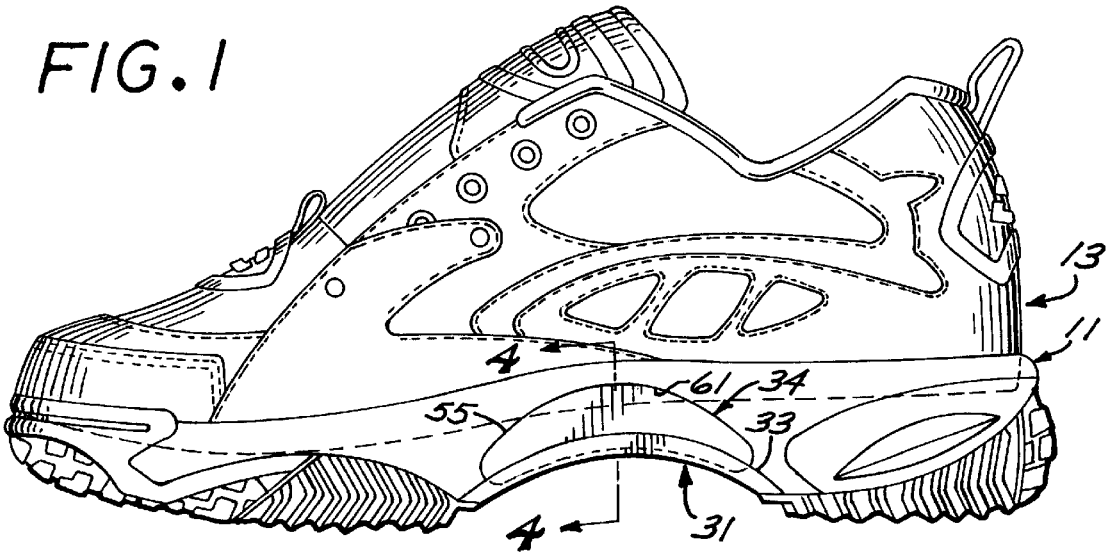
FIG. 1 is a left side view of a grind shoe apparatus of the present invention.
Figure 2:
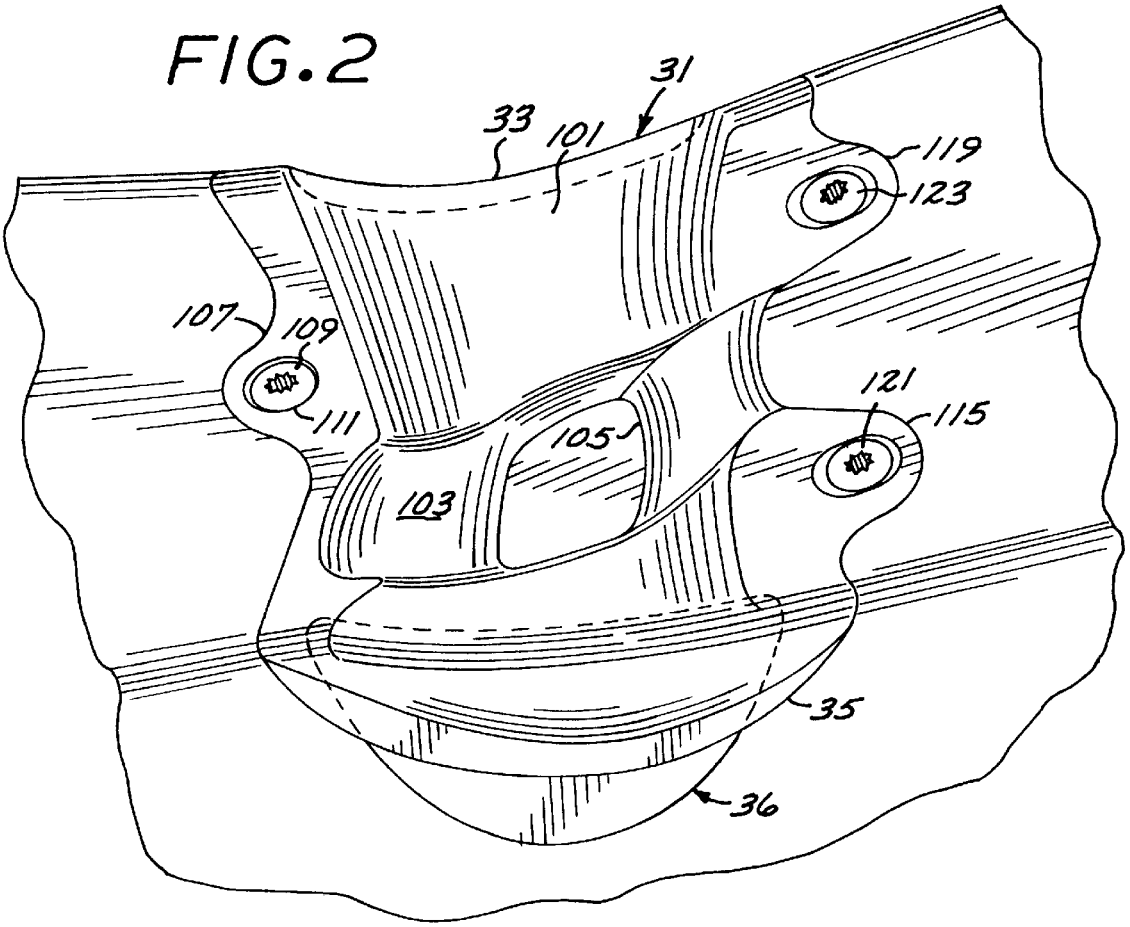
FIG. 2 is a bottom plan view, in enlarged scale of the grind shoe apparatus shown in FIG. 1, and reversed end to end.
Figure 3:
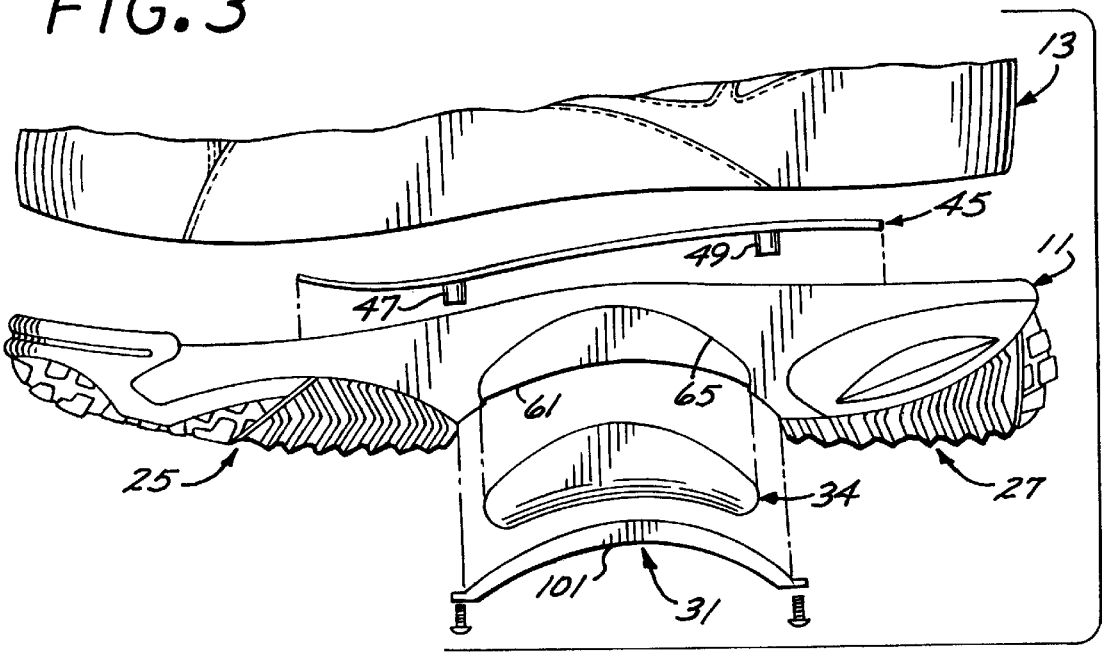
FIG. 3 is a partial exploded side view of the grind shoe apparatus shown in FIG. 1.

The shoe apparatus of the present invention, includes generally, a polyurethane midsole 11 surmounted by an upper 13 defining the upper portion of the shoe. Typically, the midsole 11 extends the length of the wearers foot and is formed medially under the arch with a upwardly raised concavity 21 and is, in practice, supported at its forward and rearward extremities with respective forefoot and heel outer soles, generally designated 25 and 27, having downwardly facing high friction tread surfaces. Received in the cavity 21 is the top side of a saddle shaped plate, generally designated 31, which is formed at its lateral opposite sides with upwardly raised longitudinal medial and lateral retainer flanges 33 and 35 that wrap upwardly a short distance on the respective medial and lateral sides of the midsole 11 in the area of the cavity 21. Interposed between such flanges and the opposite sides of the midsole 11 in the cavity area 21, are respective C-shaped in transverse cross-section medial and lateral wear resistant tabs 34 and 36. In the preferred embodiment, the tabs are adhered to the midsole II and afford protection from the polyurethane in the midsole being exposed to undue wear resulting from relative movement between the midsole and the flanges 33 and 35. In the preferred embodiment, the tabs project upwardly beyond the height of the respective retainer flanges 33 and 35 and the exterior surfaces of such tabs are textured to provide a roughened surface which can be engaged with the underlying support surface to provide a frictional braking force.

In practice, the upper shoe 13 is constructed of soft leather, polyurethane or canvas material much along the line of an athletic shoe such as a basketball shoe or tennis shoe. The midsole 11 is of generally conventional construction and is formed on its top side with a contoured upwardly facing foot support surface having an indentation formed therein for complemental receipt of a shoe frame, generally designated 45, which nests within the indentation and is itself formed with downwardly projecting fastener barrels 47 and 49 arranged in a triangular pattern and received in respective open top bores formed in the midsole in a triangular pattern.

The concavity 21 in the preferred embodiment is cylindrical and projects laterally to form at its upper extent a laterally projecting raised axis. The midsole 11 is constructed of pliant cushioning material such as to provide cushioning against shock for the bottom of the wearer's foot during running and jumping activities. It will be appreciated by those skilled in the art that such flexibility and cushioning of the midsole 11 will provide, upon application of shock forces to, for instance, the arch area, result in compression of the midsole proportional to the shock forces applied. Further, during walking and running activity, the midsole will flex as the foot of the wearer rocks forwardly with each stride, thus bending the forefoot upwardly relative to the heel area thereby causing flexure in the arch area. Applicant has discovered that this flexing of the midsole, particularly along the vertically extending sides at the medial and lateral extent of the arch area, will result in abrasion with the interior walls of the respective flanges 33 and 35. This action has proven to exhibit wear on the opposite sides of the midsole resulting in deterioration of the medial and lateral surfaces of the midsole in the arch area, thereby generating an unsightly appearance and general breakdown of the structure of such midsole. To overcome this shortcoming, I have incorporated the generally C-shaped in cross-section wear tabs 34 and 36 and mounted on the respective corners of such midsole on the opposite sides of the arch interposed between such midsole and the respective flanges 33 and 35 to minimize wear.

These tabs 34 and 36 are formed with respective vertical side walls 55 and 57 which run upwardly along the respective side walls of the midsole and are formed with the high friction textured exterior surfaces so that when the wearer leans sufficiently far over on the side of the shoe, the upper extent of the tab 34 or 36 will ride against the underlying support surface to create enhanced frictional resistance to movement and movement therealong thereby creating a breaking effect. Such tabs then wrap downwardly and inwardly to form respective bottom walls 97 and 99 (FIGS. 4 and 5).

Figure 4:
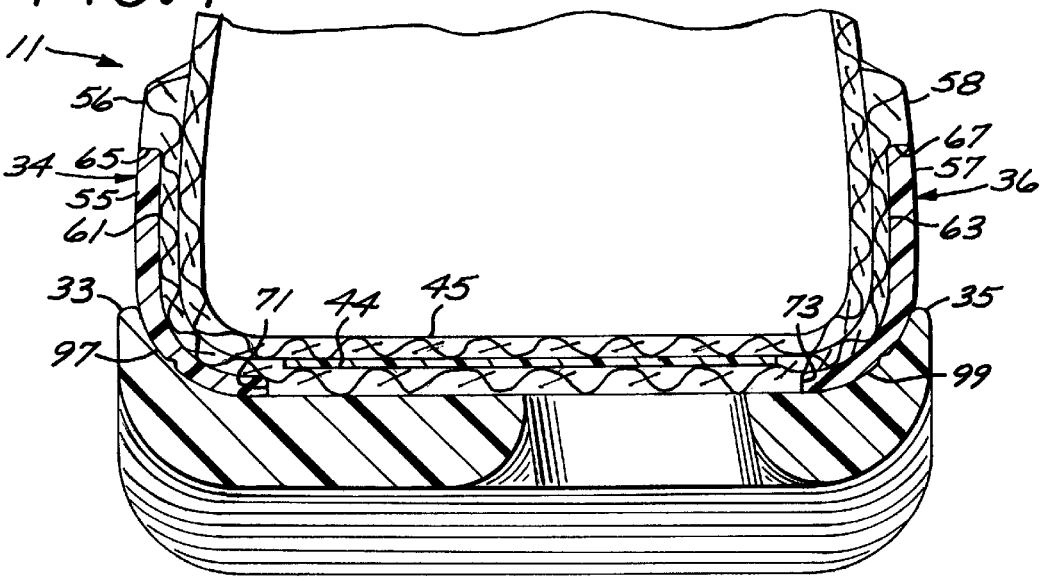
FIG. 4 is a vertical sectional view in enlarged scale taken along line 4—4 of FIG. 1.
Figure 5:
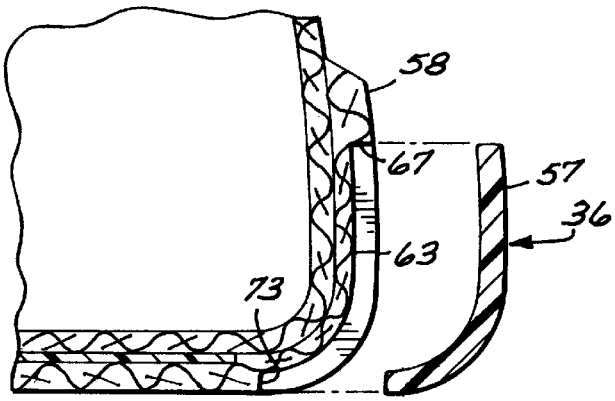
FIG. 5 is a partial exploded sectional view taken from FIG. 4.

Referring to FIGS. 4 and 5, it will be appreciated that in lateral cross-sectional views, the midsole 11 is formed to wrap upwardly of the opposite sides of the upper 13 to form the respective medial and lateral sidewalls 56 and 58. I have formed the opposite sides walls of the midsole with centrally located 1.5 mm deep medial and lateral indentations 61 and 63 which are generally crescent shaped to form at their upper extent generally circular shaped top edges 65 and 67. Such indentations wrap downwardly and inwardly a short distance under the bottom of the shoe to terminate in respective longitudinal inner edges 71 and 73.

The tabs 34 and 36 are preferably constructed of highly abrasive impregnated cloth about 1 mm thick such as material sold by DuPont either under the trademark KEVLAR® or WEARFORCE®. The C-shape of the tabs 34 and 36 serve to form the respective vertical sidewalls 55 and 57 in a generally crescent shape projecting upwardly about 20 mm above the transversely extended surface at the apex of the concavity 21 along their major heights and terminating in respective top edges curved to be complementally received against the respective top edges 65 and 67 of the respective indentations 61 and 63. The tabs 34 and 36 are configured to extend downwardly and curve inwardly about the respective bottom comers of the midsole to form the horizontal bottom walls 97 and 99 which terminate in respective inner edges to complementally nest in the respective indentations and abut the respective longitudinal bottom edges 71 and 73 thereof (FIG. 4). The vertical tab walls 55 and 57 project upwardly above the upper extent of the respective runners 33 and 35 a distance of about 15 mm sufficient so that when the wearer leans the shoe over on the side to a sufficient extent, the roughened exterior surface of such wall will contact the underlying support surface. The exterior surface of such wall is highly textured so that it exhibits a high degree of frictional resistance thereby acting as a breaking force when engagement is made with the underlying surface.

I have selected plate 31 as a frame which can support underlying grooves, low friction ribs or rollers which serve to provide for low resistance sliding or rolling across the underlying support surface. As used herein, the term plate is used in the normal sense to encompass a plate with a raised medial area having a downwardly facing surface. As understood by those skilled in the art, that surface may be in the form of a low friction material or may support rollers or the like which carry the weight of the user.

The configuration of the plate I have selected for illustrative purposes recognizes and compliments the shape of the cavity 21 when viewed in both elevation and bottom plan view. The plate 31 is formed with a downwardly opening trough 101 in the form of a sector of a circle and having medial and lateral bearing surfaces disposed on the opposite sides of a longitudinal groove 103 having a through window 105 formed therein. The plate 31 is formed centrally at its rearward extremity with a central, rearwardly projecting mounting ear 107 formed with a countersunk bore 109 configured to receive the head of a fastener 111 received at its opposite end in the barrel 47 of the frame 45. The front extremity of the plate 31 is configured with forwardly projecting laterally disposed flanking ears 115 and 119 configured with countersunk, longitudinal through slots for receiving the heads of respective fasteners 121 and 123 carried from respective threaded shanks which are received in the respective fastener barrels 49.

It will be appreciated to those skilled in the art that wear resistant tabs 34 and 35 of the present invention may take many different forms, it only being important in one aspect of the invention that such tabs serve to protect the midsole from abrasion against the inner surface of the associated flange. It will be appreciated that in various configurations the plate may extend forwardly and rearwardly within the midsole and that the edges thereof may exhibit relative movements against different areas of the midsole. In that event, the wear resistant tabs would be configured to compliment the particular interface between the midsole and plate. The invention can take many different forms, in some instances incorporating a tab on only one side of the insole and in some instances serving to provide a roughened high friction exterior to serve as a brake.

In operation, it will be appreciated that the polyurethane midsole 11 of the present invention will be molded or otherwise formed at the factory. The soles will be configured with the raised arch cavity 21 and with the oppositely disposed medial and lateral indentations 61 and 63 (FIG. 4). The wear tabs 34 and 36 will be preformed of a highly resistant material such as that sold by DuPont under the trademark WEARFORCE® and will be shaped and configured to be complementally received within the respective indentations. In assembly, the midsole will be formed with the indentation for receipt of the shoe frame 45 and with bores located in a triangular pattern for receipt of the respective fasteners 111, 121 and 123. The plate 31 is constructed of a high strength material depending on the particular end configuration sought. In the case where the plate 31 is to slide directly on the underlying support surface, it may be constructed of a high grade, low coefficient of nylon such as that sold under the trademark SUPERTUF® nylon 11 available from DuPont, nylon 6 or a plastic such as that sold under the trademark PTEX® or possibly hard rubber, glass, ceramic, metal, polyurethane, composites or the like. As used herein, I intend the term low coefficient of friction, as applied to the grind plate, to mean it is more slippery than the bottom surface of the heel and forefoot outer soles of a tennis shoe of the type shown in FIG. 1. The prefabricated plate 31 will be nested in the cavity 21 with the shoe frame 45 in position in the indentation 44 on the top of the midsole, hence the fasteners 111, 121 and 123 may then be inserted and tightened in position. The front fasteners 121 and 123 may include tubular spacers to stand the respective heads off slightly to provide a certain degree of slack so that there is freedom of movement of the midsole over the rear fastener ears 115 and 119 relative to the rearward fastener ear 107 to thereby allow for flex of the midsole to accommodate the gait of the wearer during walking and running maneuvers.

When the wearer dons the shoes for casual wear or athletic maneuvers, it will be appreciated that the overall construction will provide for flex of the midsole during walking, running and jumping maneuvers and will provide for cushioning of the wearer's foot during high shock maneuvers such as when the entire weight of the wearer during a jumping activity is to be resisted by encounter of the grind plate against the rigid underlying support surface such as the edge of a curb. In any event, as the wearer flexes the midsole relative to the comparatively rigid grind plate 31, relative movement will be experienced between the opposed flanges 33 and 35 and the wear tabs 34 and 36. This relative movement, whether from compressive forces on the cushioning characteristic of the midsole or flexure of the midsole during walking or running, maneuvers will allow such relative movement to take place between the outer surface of the respective tabs 34 and 36 and the adjacent surface of the grinding plate and the inside surfaces of the respective flanges 33 and 35. Thus, the exterior surface of the midsole immediately inwardly from the respective flanges 33 and 35 will be protected from undue wear. The midsole 11 is thus protected from undue wear and will result in the midsole itself often times outlasting grind plate 31 itself. It is thus desirable to change a grind plate when worn or thinned out by excessive use. The fasteners 111, 121 and 123 may be easily removed and the grind plate 31 replaced with a new grind plate hence, the wear resistance tabs 34 and 36 will then continue to provide resistance against undue wear between the shoe and the new grind plate.

When the wearer elects to undertake an extreme athletic maneuver in a grinding exercise, the knee of the leg wearing the shoe may be layed over at such an extreme angle, that the medial side of the shoe will be layed over and to a highly inclined plane, thus causing the outwardly facing exterior surface of the sidewall 91 projecting above the runner to be pressed downwardly against the underlying support surface. The highly textured exterior surface of the vertical wall 91 will thus afford a resistance to continued travel of the shoe along the underlying surface thus applying a braking force. It will be appreciated that the magnitude of such braking force may be varied by the extent of surface contact and the weight applied to the inwardly inclined shoe. Similarly, when the foot is layed over on the lateral side, the lateral tab will be in position to be contacted with the underlying support surface to impart a braking force proportional to the weight applied thereto. It will be appreciated by those skilled in the art that the tab may be constructed and oriented to serve as a braking tab on only one side of the shoe as, for instance, on the lateral side only.

From the foregoing it will be appreciated that the wear resistant grind shoe apparatus of the present invention provides an economical and effective apparatus for executing a grinding maneuver where the shoe is economical to manufacture and is subject to an extended life without undue wear or structural breakdown.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. Shoe apparatus for riding along an elongated support surface, comprising:

a compressible midsole formed in the arch area with a downwardly opening cavity having a predetermined configuration and medial and lateral upturned walls;

a rigid riding plate having medial and lateral sides and configured on its upper side to complement said predetermined configuration and being formed with a downwardly facing surface to, in use, be directed over said elongated support surface;

said plate being formed on at least one side with an upwardly raised flange flanking the adjacent upturned wall of said midsole; and a wear resistant tab interposed between said adjacent side of said midsole and an inwardly facing surface of said flange, said tab being attached to said midsole and configured to slidingly engage said inwardly facing surface as said cushioned midsole in said arch area is compressed and released.

2. A shoe apparatus as set forth in claim 1 wherein:

said tab is constructed of wear resistant cloth.

3. A shoe apparatus as set forth in claim 1 wherein:

said plate is formed on both sides with elongated flanges flanking the respective said upturned walls of said midsole in said arch area, and wear resistant tabs on both said upturned sides of said midsole confronting the respective said flanges.

4. A shoe apparatus as set forth in claim 1 wherein:

said plate is arched on the bottom side to form a trough having an uppermost extent along a laterally projecting raised axis.

5. A shoe apparatus as set forth in claim 1 that includes:

an anchor plate disposed in underlying relationship on said midsole.

6. A shoe apparatus as set forth in claim 5 that includes:

fasteners interconnecting said anchor plate and riding plate.

7. A shoe apparatus as set forth in claim 4 wherein:

said tab is formed with a vertical wall that is crescent shaped.

8. A shoe apparatus as set forth in claim 1 wherein:

said riding plate is formed with a downwardly facing low friction bearing surface for engaging said elongated support surface.

9. A shoe apparatus as set forth in claim 1 wherein:

said tab projects upwardly beyond a horizontal plane projecting through an uppermost extent of said flange.

10. A shoe apparatus as set forth in claim 9 wherein:

said tab projects sufficiently far above said horizontal plane such that the upper portion of said tab slidingly contacts said support surface when said shoe apparatus is leaned over on one side.

11. A shoe apparatus as set forth in claim 10 wherein:

the outer surface of said upper portion is constructed to form an outwardly facing high friction surface.

12. A shoe apparatus as set forth in claim 8 wherein:

said plate is formed with a downwardly opening trough defining said bearing surface.

13. A shoe apparatus as set forth in claim 1 wherein:

said plate is constructed of nylon.

14. A shoe apparatus as set forth in claim 1 wherein:

said plate is constructed of polyurethane.

15. A shoe apparatus as set forth in claim 1 wherein:

said plate is constructed of plastic.

16. A shoe apparatus as set forth in claim 1 wherein:

said tab projects upwardly beyond a horizontal plane projecting through an uppermost extent of said flange.

17. A shoe apparatus as set forth in claim 16 wherein:

said tab projects sufficiently above said horizontal plane such that the upper portion of said tab slidingly contacts said support surface when said shoe apparatus is leaned over on one side.

18. A shoe apparatus as set forth in claim 1 wherein:

said tab is formed with a vertical side wall and horizontally projecting bottom wall.

19. A shoe apparatus as set forth in claim 1 wherein:

said midsole is formed with an indentation of a predetermined shape in said adjacent upturned side wall;

said tab is formed with a vertical wall configured to compliment said predetermined shape and be nested in said indentation.

20. A shoe apparatus for riding along an elongated bearing surface, comprising:

a flexible midsole formed with a high friction downwardly facing support surface and configured with a downwardly opening cavity of a predetermined configuration;

a rigid riding plate configured on its lower side for sliding over said support surface and on its upper side to complementally fit in said cavity, said plate including at least one upwardly projecting flange disposed adjacent a portion of said midsole to accommodate, upon flexure of said midsole, movement of said portion relative to said flange; and a wear resistant tab affixed on said portion and including an outwardly facing surface constructed to slidingly engage an inwardly facing surface of said flange upon movement of said portion relative to said flange.

21. Shoe apparatus for riding along an elongated support surface, comprising:

a midsole formed in the arch area with a downwardly opening cavity having a predetermined configuration and medial and lateral upturned sidewalls;

a rigid riding plate having medial and lateral sides and configured on its upper side to complement said predetermined configuration and being formed with a downwardly facing surface to, in use, be directed over said elongated support surface; and a brake tab, mounted on one side of said midsole on one side of said cavity and configured with a vertical wall projecting up along said one side of said midsole, said vertical wall being formed with a rough surface arranged so that when said shoe apparatus is leaned over to one side, said rough outer surface will be engaged with said support surface.

22. A shoe apparatus as set forth in claim 21 wherein:

said plate includes a retainer flange projecting upwardly along said one side of said midsole; and said vertical wall of said tab projects vertically above the level of the upper extent of said flange.

23. A shoe apparatus as set forth in claim 21 wherein:

said plate includes retainer flanges projecting outwardly along both said upward side walls and said apparatus includes:

brake tabs mounted on said side walls of said midsole and projecting upwardly above a height of the respective said flanges and formed with outwardly facing rough surfaces positioned to, when said apparatus is leaned over in a respective lateral direction toward one of said tabs, said rough surface of said one of said tabs will contact said support surface.

* * * * *